United States Patent [19]

Larson

[11] Patent Number: 4,462,444

[45] Date of Patent: Jul. 31, 1984

[54] INSULATING JACKET FOR A BEVERAGE CONTAINER

[75] Inventor: Fred G. Larson, Brainerd, Minn.

[73] Assignee: Pocket Cooler Company, Brainerd, Minn.

[21] Appl. No.: 441,044

[22] Filed: Nov. 12, 1982

[51] Int. Cl.[3] ..... B65B 11/00

[52] U.S. Cl. ..... 150/52 R; 215/12 A; 215/100.5

[58] Field of Search ..... 150/52 R, 40; 215/12 A, 215/100.5, 12 R; 224/148; D7/70

[56] References Cited

U.S. PATENT DOCUMENTS

| | | | |
|---|---|---|---|
| D. 266,048 | 9/1982 | Zills | 150/52 R X |
| 2,035,384 | 3/1936 | Hinchliff | 215/100.5 X |
| 2,482,322 | 9/1949 | Coatese | 150/52 R X |
| 2,522,381 | 9/1950 | Kramer | 215/12 A |
| 2,568,623 | 9/1951 | Hamm | 215/100.5 |
| 2,685,318 | 8/1954 | Merkle | 215/100.5 X |
| 2,779,495 | 1/1957 | Davis | 215/100.5 |
| 2,832,493 | 4/1958 | Murphy . | |
| 3,374,298 | 3/1968 | Studen | 215/100.5 X |
| 3,473,682 | 10/1969 | Studen . | |
| 3,633,863 | 1/1972 | Abbey . | |
| 3,738,529 | 6/1973 | Rose . | |
| 3,779,298 | 12/1973 | Piccirilli et al. | 150/52 R |
| 4,282,279 | 8/1981 | Strickland | 215/12 A X |
| 4,293,015 | 10/1981 | McGough | 150/52 R |
| 4,340,146 | 7/1982 | Stratton . | |
| 4,372,453 | 2/1983 | Branscum | 215/100.5 X |

*Primary Examiner*—William Price
*Assistant Examiner*—Sue A. Weaver
*Attorney, Agent, or Firm*—Merchant, Gould, Smith, Edell, Welter & Schmidt

[57] ABSTRACT

An insulating jacket for a beverage container is disclosed. The jacket 10 includes an outer cover and an inner liner with a resilient insulating material therebetween. Thread at the seams fasten the upper and lower ends and the side ends to form the jacket into an endless covering. The folded outer covering extending beyond the upper and lower seams provides a resisting mechanism against forcing a container completely through the jacket. The jacket, thus, not only provides insulation from heat transfer, but also holds a container above a table top to eliminate moisture deposit.

4 Claims, 4 Drawing Figures

FIG. 1
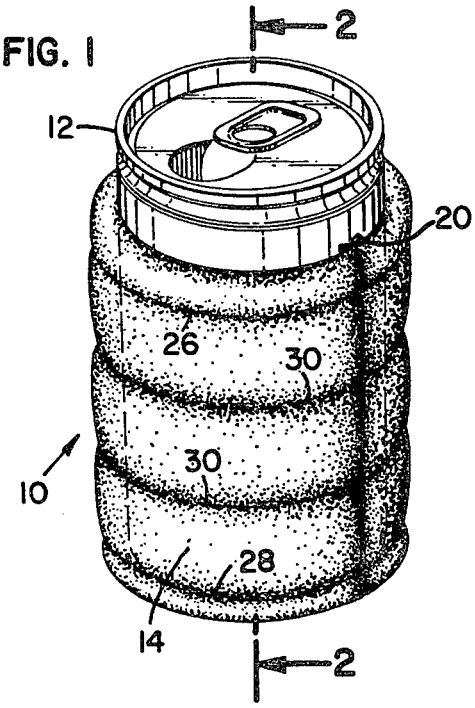
FIG. 2
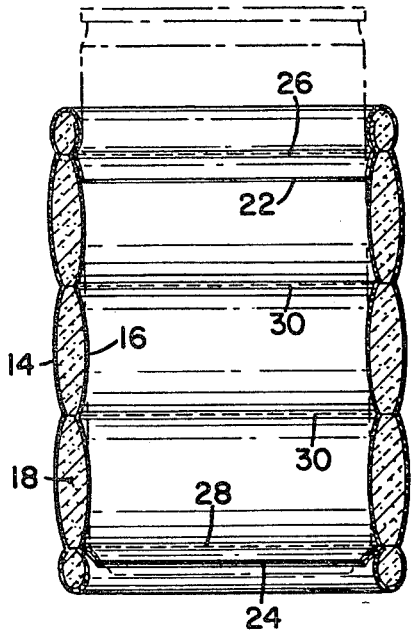
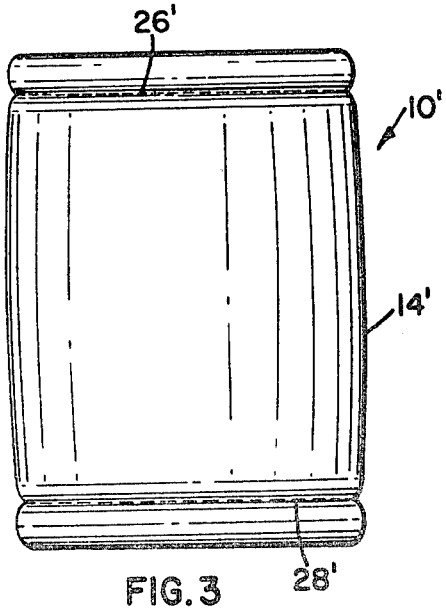
FIG. 3
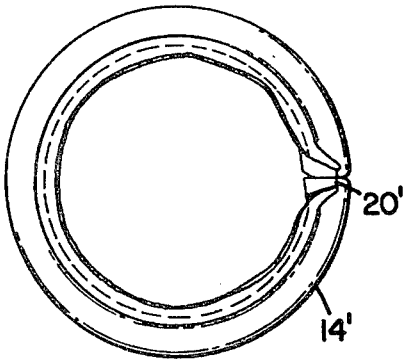
FIG. 4

INSULATING JACKET FOR A BEVERAGE CONTAINER

FIELD OF THE INVENTION

This invention relates to an insulating jacket for a beverage container. The jacket not only reduces heat transfer through the container wall, but also virtually elimintes condensative dribble.

BACKGROUND OF THE INVENTION

Insulating holders and jackets for glasses, cans and other beverage containers are known. Styrofoam holders were commonly used for several years. Styrofoam holders, however, have a relatively short lifetime since the styrofoam is easily chipped and broken. Also, foam rubber of various densities has been used for holders and jackets. Again, the foam rubber material deteriorates quite rapidly, and it is not uncommon for pieces to be pulled from a holder or jacket. Both styrofoam and foam rubber commonly remain acceptable for guest use for only a relatively short period.

More recently, U.S. Pat. Nos. 4,293,015 and 4,282,279 have shown a holder and jacket, respectively, which are made to have a longer lifetime in contrast to the above mentioned styrofoam and foam rubber holders and jackets. U.S. Pat. No. 4,293,015 shows an insulating holder having a bottom and an elastic top band for squeezing the beverage container. Inner and outer walls between the bottom and the top band contain goose down or something similar for insulative purposes. The problem with such a holder, however, is that it is more complex than necessary for the functions it accomplishes. In particular, a compartmentalized jacket structure is taught wherein goose down or a similar insulative material is contained therein. Because such materials have no natural elasticity, an elastic band is attached near the top of the jacket portion of the holder. Furthermore, a bottom is needed to space the beverage container from a table surface and prevent the untidy, watery ring which otherwise commonly forms.

U.S. Pat. No. 4,282,279 shows a jacket without an elastic band or bottom. The jacket disclosed is a wrap-around type with a fastening mechanism made from hook and loop material. The insulating material is somewhat resilient. In one embodiment, however, a string is used to draw at least one end of the jacket tightly around the container. Although the jacket has greater versatility than the type of U.S. Pat. No. 4,293,015, it remains more complex and expensive than necessary with the necessity of the hook and loop material. Additionally, it is difficult for some people to wrap and stretch a jacket of this type and fasten at opposite ends without spilling some of the liquid in the container.

Thus, although the art includes various jackets and holders for beverage containers, each has disadvantages not heretofore adequately addressed.

SUMMARY OF THE INVENTION

The present invention is directed to a jacket for a beverage container having an outer cover and an inner resilient insulating material which is lined with preferably a cloth material. At the top and bottom, the outer cover is folded over the inner insulating material and liner. A stitching at both the top and bottom ends holds the various materials in place relative to one another. A further stitching forms the jacket into an endless covering suitable for fitting a body container.

Since soft drink and alcoholic beverages are marketed in alloy or aluminum cans having a standard diameter, it is appropriate to fasten the ends of the jacket to form an endless covering capable of providing an internal opening equivalent to the indicated standard diameter. Such stitching is advantageous in that it eliminates, for example, the need for hook and loop material as shown in a prior patent. Furthermore, since a resilient or deformable insulating material is preferred in the present invention, a jacket is formed to have an internal diameter somewhat smaller than the standard diameter of beverage cans. In that fashion, the natural elasticity of the deformable or resilient insulating material allows the jacket to cling to the container thereby avoiding any necessity for an elastic material such as needed by a disclosure in the art.

As a matter of fact, the present jacket, is surprisingly advantageous as a result of the upper and lower folds and stitchings which hold the folds and the various materials in place. When a top and bottom stitching is made, it is necessary to leave the very end of the folded outer cover extending beyond the stitching. As a can is inserted into one of the openings of the jacket, therefore, the insertion end of the folded outer cover simply presses against the liner and insulating material to allow ingress of the can. However, as the bottom of the can approaches the bottom of the jacket, the bottom rim of the can catches the end of the folded cover near the bottom stitching and resists further movement of the can. In this fashion, the jacket holds the can a spaced distance from a table top. Therefore, a bottom is not needed for the jacket, and dribble is avoided since the can does not touch the table top.

Although the present jacket is simple, a number of further advantages are realized over the art. For example, with the use of vinyl as a preferable outer covering, a large outer service is available for catchy slogans or advertising. A vinyl covering is also very easy to clean. The jacket is virtually unbreakable and remains nice looking for enumerable uses. The jacket is manufactured to provide an appropriate fit and, consequently, is non-bulky and comfortable to hold. Yet, the jacket is easily placed on a container and taken off thereafter. Since the present jacket is soft and foldable, it is portable for use repeatedly and almost anywhere. In short, the present jacket provides a structure having many of the advantages of such a device and yet avoids disadvantages of previous devices directed toward a similar purpose.

BRIEF DESCRIPTION OF THE DRAWINGS

FIG. 1 is a perspective view showing a jacket in accordance with the present invention in place about a representative beverage container;

FIG. 2 is a cross sectional of view taken along line 2—2 of FIG. 1;

FIG. 3 is a side view of another embodiment of the present invention;

FIG. 4 is a top view of the embodiment shown in FIG. 3.

DETAILED DESCRIPTION OF THE PREFERRED EMBODIMENT

Referring now to the drawings wherein like reference numerals designate identical or corresponding parts throughout the several views, and more particularly to FIG. 1, a jacket in accordance with the present invention is designated generally as 10. Jacket 10 is shown in place about a representative beverage container 12. As shown in cross section in FIG. 2, jacket 10 includes an outer cover 14 and an inner liner 16 with insulating material 18 therebetween.

Each of the three materials 14, 16, 18 have first ends which function as top and bottom ends of jacket 10 and second ends which are substantially perpendicular to the first ends and which are fastened together by a seam 20 as discussed hereinafter. Preferably, insulating material 18 and liner 16 have substantially the same size so that the first and second ends of each coincide. Liner 16, in fact, may be adhesively or otherwise attached to the inner side of insulating material 18, or liner 16 may be separate there from. In comparison to the other two materials, however, outer cover 14 has a longer length between its first ends. The length between its second ends is substantially the same as that of insulating material 18 and liner 16. Each of the first ends 22 and 24 are folded over the first ends of insulating material 18 and liner 16. A pair of first seams 26, 28 fasten between the folded walls of outer cover 14, the first end portions of insulating material 18 and liner 16. The seams are commonly comprised of a thread although they may be made from leather or other less common material. A second seam 20, mentioned hereinbefore, fastens the inturned second ends of the three items 14, 16, 18 as shown in FIG. 4. Although the construction described thus far is shown in FIGS. 3 and 4 and is sufficient for a jacket in accordance with the present invention, it is appropriate, and often decorative, to add further seams 30 running circumferentially about jacket 10 at spaced locations from one another and from first seams 26, 28 as shown in FIGS. 1 and 2. Seams 30 could also run in other directions, even vertically between the open ends of jacket 10.

Outer cover 14 is preferably made from a vinyl material, although leather, velour or other materials may be used as well. Vinyl, however, looks rich, is easy to clean, and is particularly appropriate for applying slogans and various advertising messages. Liner 16 is preferably a cloth or other absorbent material for retaining any moisture which forms on the outside of a container 12. Insulating material 18 is made from a resilient or deformable foam or other material. Since insulating material 18 is deformable, it is appropriate to make the internal perimeter of jacket 10 somewhat smaller than the circumference of container 12. In that fashion, as container 12 is inserted into jacket 10, insulating material 18 compresses or deforms so as to squeeze against container 12 and retain jacket 10 on container 12.

Jacket 10 is easily used in that the bottom end of a container 12 is simply inserted into one end of jacket 10. Since insulating material 18 must be slightly compressed or deformed, a small force must be applied to container 12 to insert it into jacket 10. As the bottom of container 12 contacts the folded end of what becomes the bottom end of jacket 10 and, as shown in FIG. 2, a folded end 24 of cover 14 is moved somewhat inwardly and resists further movement through jacket 10 of container 12. In this fashion, a person is immediately aware of the extent of insertion of container 12 into jacket 10 and just naturally stops moving container 12 further with respect to jacket 10. When the assembly is placed on a table top, container 12 is then spaced from the table top since jacket 10 extends a slight distance below the bottom of container 12. Additionally, it is preferable to construct jacket 10 with a length which does not extend from end to end of container 12. Then, there is commonly sufficient space between the top of jacket 10 and the top of container 12 for a person to easily place his or her mouth in the usual drinking position.

Jacket 10 is removed from an emptied container 12 by simply pulling container 12 from jacket 10.

Jacket 10' is shown in FIGS. 3 and 4 and is similar to jacket 10 except it does not include seams 30. Jacket 10' does include first seams 26', 28' and second seam 20'. The folded end portion of outer cover 14' which allows a can to be inserted at one end of jacket 10' but resists the can from passing completely through jacket 10' is shown in FIG. 4.

Thus, numerous characteristics and advantages of this invention have been disclosed hereinbefore, together with details of structure and function. It is to be understood, however, that this disclosure is illustrative only. Thus, any changes made, especially in matters of shape, size, or arrangement, to the full extent extended by the general meaning of the terms in which the appended claims are expressed, are within the principle of this invention.

What is claimed is:

1. A jacket for fitting about a beverage container, comprising:

an outer cover;

an inner liner;

insulating material; and means for fastening said insulating material between said outer cover and said inner liner to form a continuous wall with first and second open ends, said fastening means including means for resisting egress of said container from said first open end after said container has ingressed through said second open end.

2. A jacket in accordance with claim 1 wherein said resisting means includes a first seam attaching said inner liner and said insulating material between a folded end portion of said outer cover and an unfolded portion of said outer cover, said end portion extending beyond said seam to an end edge of said outer cover.

3. A jacket in accordance with claim 2 wherein said fastening means includes a second seam like said first seam at the second open end.

4. A jacket in accordance with claim 1 wherein said outer cover is a vinyl material thereby making said cover available as an advertising surface.

* * * * *

UNITED STATES PATENT AND TRADEMARK OFFICE

CERTIFICATE OF CORRECTION

PATENT NO. : 4,462,444

DATED : July 31, 1984

INVENTOR(S) : Fred G. Larson

It is certified that error appears in the above-identified patent and that said Letters Patent is hereby corrected as shown below:

Column 1, line 9, delete "elimintes" and insert therefor --eliminates--.

Column 2, line 39, delete "service" and insert therefor --surface--.

Column 3, line 16, delete "there from" and insert therefor --therefrom--.

Signed and Sealed this

*Twenty-sixth* Day of *February 1985*

[SEAL]

*Attest:*

DONALD J. QUIGG

*Attesting Officer*

*Acting Commissioner of Patents and Trademarks*